US011843159B2

(12) United States Patent
Kosaka et al.

(10) Patent No.: US 11,843,159 B2
(45) Date of Patent: Dec. 12, 2023

(54) SPLIT RING RESONATOR AND COMMUNICATION DEVICE

(71) Applicant: JAPAN AVIATION ELECTRONICS INDUSTRY, LIMITED, Tokyo (JP)

(72) Inventors: Keishi Kosaka, Tokyo (JP); Yasuhiko Matsunaga, Tokyo (JP); Eiji Hankui, Tokyo (JP); Hiroshi Toyao, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 250 days.

(21) Appl. No.: 17/298,269

(22) PCT Filed: Mar. 9, 2020

(86) PCT No.: PCT/JP2020/010052
§ 371 (c)(1),
(2) Date: May 28, 2021

(87) PCT Pub. No.: WO2020/213295
PCT Pub. Date: Oct. 22, 2020

(65) Prior Publication Data

US 2022/0029269 A1 Jan. 27, 2022

(30) Foreign Application Priority Data

Apr. 17, 2019 (JP) ..... 2019-078215

(51) Int. Cl.
*H01P 1/203* (2006.01)
*H01P 7/08* (2006.01)

(52) U.S. Cl.
CPC ..... *H01P 7/08* (2013.01); *H01P 1/203* (2013.01); *H01P 1/20381* (2013.01)

(58) Field of Classification Search
CPC .. H01P 7/08; H01P 7/082; H01P 7/084; H01P 7/088; H01P 1/203; H01P 1/20327;
(Continued)

(56) References Cited

U.S. PATENT DOCUMENTS 10,374,285 B2 8/2019 Miura
2014/0203993 A1 7/2014 Toyao
(Continued)

FOREIGN PATENT DOCUMENTS

CN 106063031 A 10/2016
EP 3790114 A1 3/2021
(Continued)

OTHER PUBLICATIONS

International Search Report (ISR) (and English language translation thereof) dated May 19, 2020 issued in International Application No. PCT/JP2020/010052.
(Continued)

*Primary Examiner* — Stephen E. Jones
(74) *Attorney, Agent, or Firm* — Holtz, Holtz & Volek PC

(57) ABSTRACT

A split ring resonator includes a first conductive member having a split ring shape, a second conductive member, and a third conductive member. The second and third conductive members have a split therebetween and are electrically connected with different ends of the first conductive member. The second conductive member includes a first portion belonging to a first layer substantially parallel to a plane to which the first conductive member belongs, a second portion belonging to a second layer substantially parallel to the plane and facing the first layer, and a third portion electrically connecting the first and second portions. The third conductive member includes fourth and fifth portion respectively belonging to the first and second layers, and a sixth portion electrically connecting the fourth and fifth portions. At least parts of the first and fifth portions face each other in a direction substantially perpendicular to the plane.

12 Claims, 13 Drawing Sheets

(58) Field of Classification Search
CPC ..... H01P 1/20345; H01P 1/20354; H01P 1/20363; H01P 1/20381
See application file for complete search history.

(56) References Cited

U.S. PATENT DOCUMENTS

| | | | |
|---|---|---|---|
| 2015/0380809 | A1 | 12/2015 | Uchida |
| 2017/0040689 | A1 | 2/2017 | Toyao |
| 2018/0062271 | A1 | 3/2018 | Toyao |
| 2021/0210831 | A1 | 7/2021 | Kosaka et al. |

FOREIGN PATENT DOCUMENTS

| | | | |
|---|---|---|---|
| WO | 2013027824 | A1 | 2/2013 |
| WO | 2014132590 | A1 | 9/2014 |
| WO | 2016148274 | A1 | 9/2016 |

OTHER PUBLICATIONS

Written Opinion dated May 19, 2020 issued in International Application No. PCT/JP2020/010052.

Hashemi, et al., "Compact negative-epsilon stop-band structures based on double layer chiral inclusions", IET Microwaves, Antennas & Propagation, 2013, vol. 7, Iss. 8, pp. 621-629.

Chinese Office Action dated Mar. 30, 2022, issued in counterpart Chinese Application No. 202080006579.6.

Chinese Office Action (and English translation thereof) dated Sep. 28, 2021, issued in counterpart Chinese Application No. 202080006579.6.

Extended European Search Report (EESR) dated Nov. 26, 2021, issued in European Application No. 20792045.5.

Tamura, et al., "Novel Vertical Split Ring Resonator Fabricated in LTCC", 2007 Korea-Japan Microwave Conference, 105-108.

Korean Office Action dated Aug. 23, 2022 (and English translation thereof) issued in counterpart Korean Application No. 10-2021-7016260.

Wu, "RFID antenna technology in UHF frequency band", Northwestern Polytechnical University Press, 101-105, Sep. 30, 2015.

A6

A6

SPLIT RING RESONATOR AND COMMUNICATION DEVICE

TECHNICAL FIELD

This invention relates to a split ring resonator and a communication device.

BACKGROUND ART

An antenna using a split-ring resonator is known as a small antenna used for a wireless communication device. For example, Patent Document 1 discloses a wireless communication device comprising a split-ring resonator.

PRIOR ART DOCUMENTS

Patent Document(s)

Patent Document 1: WO2013/027824

Summary of Invention

Technical Problem

For example, such a split ring resonator as Patent Document 1 might not achieve sufficient performance assumed in its design process due to its deformation, which is caused by external force, and its dimensional error near its split (error between a designed dimension of the split ring resonator and a dimension of the manufactured split ring resonator).

Solution to Problem

For example, a split ring resonator according to an aspect of the present disclosure may be a split ring resonator including a first conductive member, a second conductive member and a third conductive member, the first conductive member having a split ring shape, the second conductive member being electrically connected with one end of the first conductive member, the third conductive member being electrically connected with the other end of the first conductive member, a split being formed between the second conductive member and the third conductive member, wherein: the second conductive member includes a first portion, a second portion and a third portion, the first portion belonging to a first layer which is a layer substantially parallel to a plane to which the first conductive member belongs, the second portion belonging to a second layer which is a layer which is substantially parallel to the plane and faces the first layer, the third portion electrically connecting the first portion and the second portion with each other; the third conductive member includes a fourth portion, a fifth portion and a sixth portion, the fourth portion belonging to the first layer, the fifth portion belonging to the second layer, the sixth portion electrically connecting the fourth portion and the fifth portion with each other; at least a part of the first portion and at least a part of the fifth portion face each other in a direction substantially perpendicular to the plane; and the split includes a first split, a second split and a third split, the first split being formed between the first portion and the fourth portion, the second split being formed between the second portion and the fifth portion, the third split being formed between the part of the first portion and the part of the fifth portion which face each other in the direction substantially perpendicular to the plane. A communication device according to an aspect of the present disclosure may be, for example, a communication device comprising the split ring resonator according to an aspect of the present disclosure.

Various aspects of the present disclosure can provide a split ring resonator and a communication device which can achieve sufficient performance assumed in their design processes.

DESCRIPTION OF EMBODIMENTS

All aspects according to the present disclosure are merely examples, and they are neither intended to exclude other examples from the present disclosure nor intended to limit technical features of the invention described in Claims.

The description about combinations of the aspects according to the present disclosure may be partially omitted. Such omissions are intended to simplify the description, and they are neither intended to be excluded from the present disclosure nor intended to limit the technical scope of the invention described in Claims. All combinations of the aspects according to the present disclosure are included in the present disclosure either explicitly, implicitly or inherently with or without such omissions. Thus, all combinations of the aspects according to the present disclosure can be directly and clearly conceived from the present disclosure with or without such omission.

Figure 1:
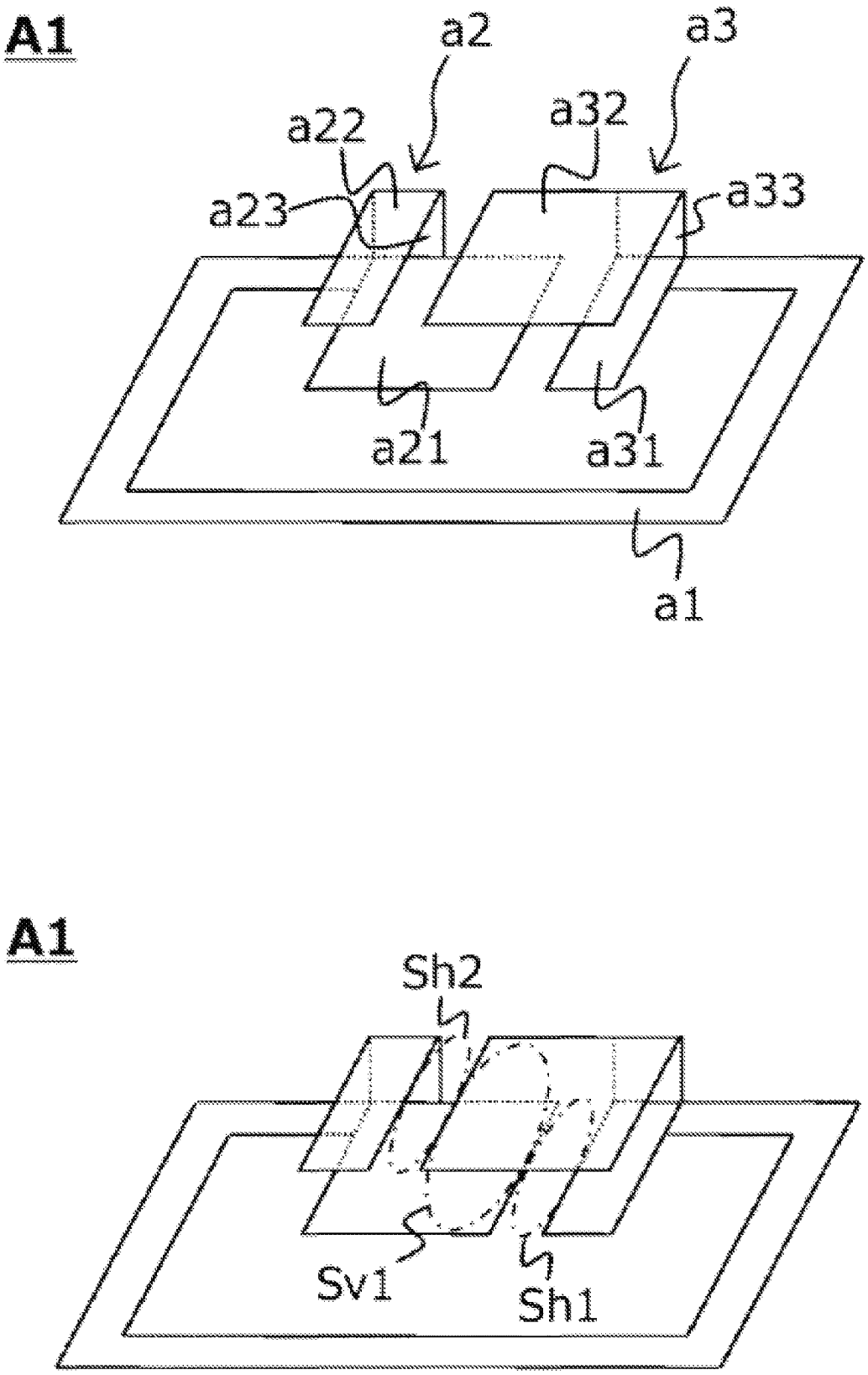
FIG. 1 is a view of an example of a split ring resonator according to an aspect of the present disclosure.
Figure 2:
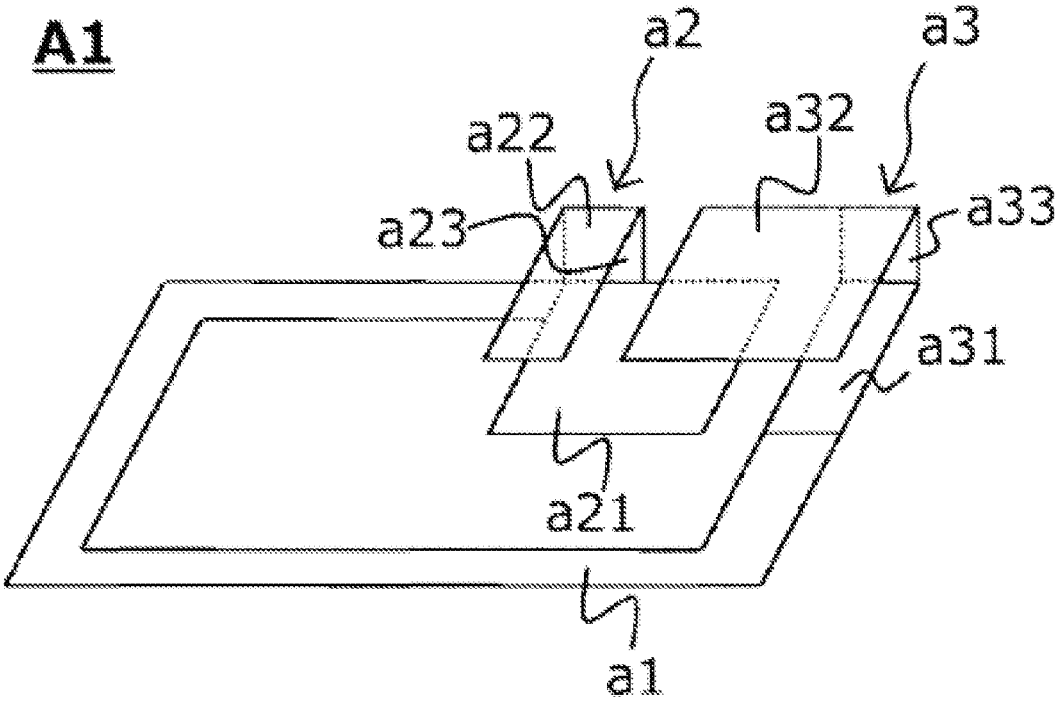
FIG. 2 is a view of an example of a split ring resonator according to an aspect of the present disclosure.

For example, as shown in FIGS. 1 and 2, a split ring resonator according to an aspect of the present disclosure may be a split ring resonator A1 including a conductive member a1, a conductive member a2 and a conductive member a3, the conductive member a1 having a split ring shape, the conductive member a2 being electrically connected with one end of the conductive member a1, the conductive member a3 being electrically connected with the other end of the conductive member a1, a split S being formed between the conductive member a2 and the conductive member a3, wherein: the conductive member a2 includes a portion a21, a portion a22 and a portion a23, the portion a21 belonging to a layer L1 which is a layer substantially parallel to a plane L0 to which the conductive member a1 belongs, the portion a22 belonging to a layer L2 which is a layer which is substantially parallel to the plane L0 and faces the layer L1, the portion a23 electrically connecting the portion a21 and the portion a22 with each other; the conductive member a3 includes a portion a31, a portion a32 and a portion a33, the portion a31 belonging to the layer L1, the portion a32 belonging to the layer L2, the portion a33 electrically connecting the portion a31 and the portion a32 with each other; at least a part of the portion a21 and at least a part of the portion a32 face each other in a direction substantially perpendicular to the plane L0; and the split S includes a split Sh1, a split Sh2 and a split Sv1, the split Sh1 being formed between the portion a21 and the portion a31, the split Sh2 being formed between the portion a22 and the portion a32, the split Sv1 being formed between the part of the portion a21 and the part of the portion a32 which face each other in the direction substantially perpendicular to the plane L0.

Hereinafter, a direction substantially parallel to the plane L0 is simply referred to as substantially horizontal direction or horizontal direction. Hereinafter, the direction substantially perpendicular to the plane L0 is simply referred to as substantially vertical direction or vertical direction. For example, the layer L1 may be same as the plane L0, or may be different from the plane L0. For example, the layer L1 may be positioned between the plane L0 and the layer L2, or the plane L0 may be positioned between the layer L1 and the layer L2.

Hereinafter, the split that is substantially parallel to the plane L0 is referred to as split Sh (Sh1, Sh2, Sh3 . . . ). Hereinafter, the split that is substantially perpendicular to the plane L0 is referred to as split Sv (Sv1, Sv2, Sv3 . . . ).

For example, each of the conductive member a1, the conductive member a2 and the conductive member a3 may be formed by cutting out it from one conductive board (metal plate) by a laser, etc. For example, each of the conductive member a1, the conductive member a2 and the conductive member a3 may be formed by bending a piece which is cut out from one conductive board (metal plate) by a laser, etc. For example, the conductive member a1, the conductive member a2 and the conductive member a3 may be integrally formed by bending a piece which is cut out from one conductive board (metal plate) by a laser, etc.

For example, the conductive member a1 may be formed to have a split ring shape. The wording of "split ring shape" includes concept which is specified by a shape based on an approximately C-shape along a rectangular-ring, or a shape based on a shape extending along one of various rings, such as a circular ring, an oval ring, a track-shaped ring, etc. For example, a region, which is formed inside the conductive member a1, may have any shape; it may have a shape of a polygon including a square, a rectangle, etc., a circle, an oval, etc.

For example, the split S may be filled with nothing, or may be filled with resin or the like. For example, the split S may have any shape; it may have a shape such as a straight line, a curved line, a zigzag line or the like. For example, the split S may have a meander shape. The wording of the meander shape includes concept which is specified by the wordings such as a zigzag shape, a comb tooth shape, and a shape based on an interdigital structure. For example, a meander shape is formed of a combination of a straight line, a curved line, a zigzag line, etc.

For example, a split ring resonator according to an aspect of the present disclosure may comprises a feed line a5 which is electrically connected with the conductive member a1. The wording of "electrical connection with the conductive member a1" includes concepts of both electrical connection by direct connection with the conductive member and electrical connection for wireless supply of electrical energy such as electromagnetic induction. The feed line a5 may be, for example, connected with any part of the conductive member a1, and impedances of an RF circuit and a split-ring resonator according to an aspect of the present disclosure can be matched to each other by adjusting a junction of the conductive member a1 with the feed line a5. For example, the feed line a5 may be configured so that the feed line a5 is provided at a layer different from the plane L0 while the feed line a5 is connected with the conductive member a1 through a via, etc. For example, the feed line a5 may extend from its junction with the conductive member a1 toward a side space of the conducive member a1 which is opposite to its junction across the region which is formed inside the conductive member a1. For example, the feed line a5 may be formed of a wire such as a transmission line or the like, or may be formed of a metal plate. For example, the conductive member a1 and the feed line a5 may be integrally formed by bending a piece which is cut out from one conductive board (metal plate) by a laser, etc.

For example, a split-ring resonator according to an aspect of the present disclosure can be recognized to be an LC resonant circuit which is composed of an inductance, which is produced at the conductive member a1 by feeding RF signal to the split-ring resonator, and a capacitance produced at the split S by feeding RF signal to the split-ring resonator. For example, in an LC resonant circuit of a split-ring resonator according to an aspect of the present disclosure (for example, the split ring resonator A1 and its modification), a capacitance, which is produced at the split Sh that is substantially parallel to the plane L0, is negligibly small with respect to a capacitance produced at the split Sv that is substantially perpendicular to the plane L0. For example, in an LC resonant circuit of a split-ring resonator according to an aspect of the present disclosure (for example, the split ring resonator A1 and its modification), the capacitance, which is produced at the split Sh that is substantially parallel to the plane L0, is not negligibly small with respect to the capacitance produced at the split Sv that is substantially perpendicular to the plane L0. In this case, both of the capacitance, which is produced at the split Sh that is substantially parallel to the plane L0, and the capacitance, which is produced at the split Sv that is substantially perpendicular to the plane L0, contribute to a resonance of the LC resonant circuit. For example, according to an aspect of the present disclosure, if the split-ring resonator is deformed by external force, for example, in the horizontal direction or if the split-ring resonator has dimensional error near the split S, for example, in the horizontal direction, there is a probability that the capacitance produced at the split Sh is changed while change of the capacitance produced at the split Sv is reduced. According to an aspect of the present disclosure, if the split-ring resonator is deformed, for example, in the vertical direction by external force or if the split-ring resonator has dimensional error near the split S, for example, in the vertical direction is produced, there is a probability that the capacitance produced at the split Sv is changed while change of the capacitance produced at the split Sh is reduced. In other words, according to an aspect of the present disclosure, for example, its deformation by external force in a direction has a small impact on its performance, and its dimensional error near the split S in a direction also has a small impact on its performance. Thus, an aspect of the present disclosure can provide a split ring resonator which can achieve sufficient performance assumed in its design process.

Figure 3:
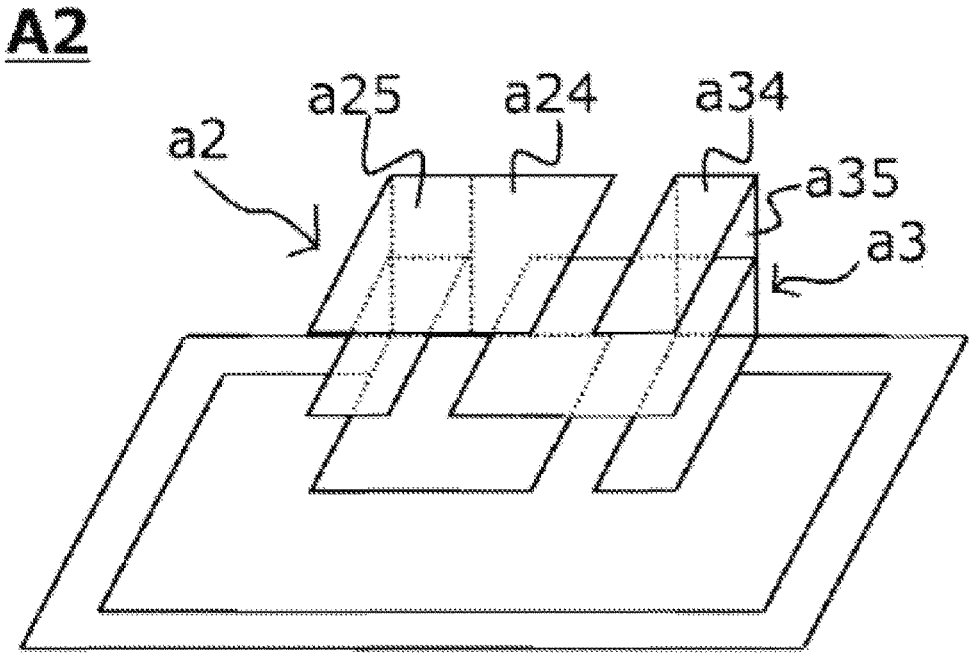
FIG. 3 is a view of an example of a split ring resonator according to an aspect of the present disclosure.
Figure 3:
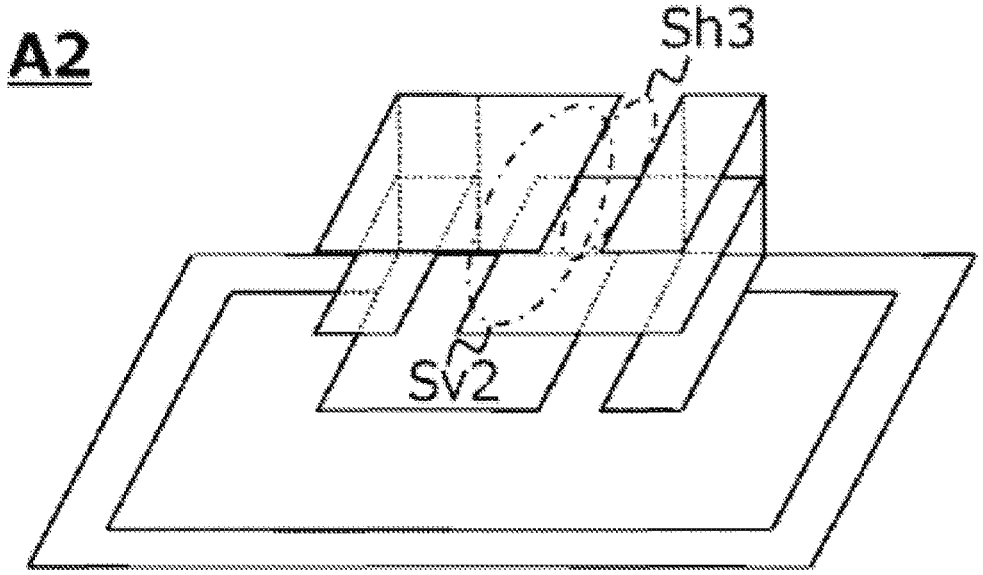
Figure 4:
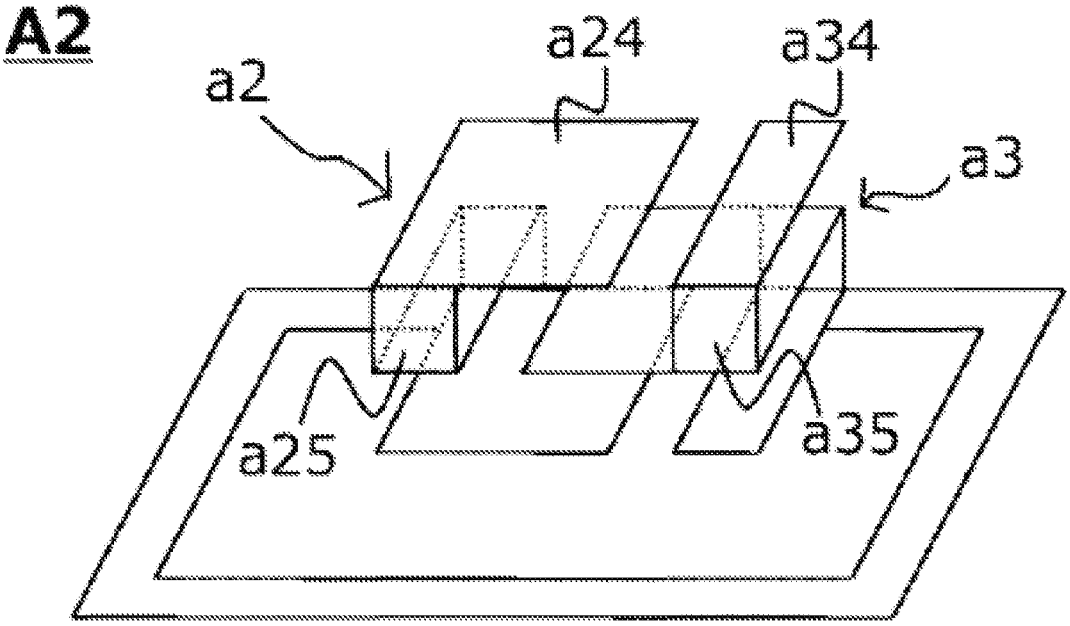
FIG. 4 is a view of an example of a split ring resonator according to an aspect of the present disclosure.

For example, as shown in FIGS. 3 and 4, a sprit-ring resonator according to an aspect of the present disclosure (for example, the split-ring resonator A1 and its modification) may be a split ring resonator A2 which is configured as follows: the conductive member a2 includes a portion a24 and a portion a25, the portion a24 belonging to a layer L3 which is a layer which is substantially parallel to the plane L0 and faces the layer L2, the portion a25 electrically connecting the portion a22 and the portion a24 with each other; the conductive portion a3 includes a portion a34 and a portion a35, the portion a34 belongings to the layer L3, the portion a35 electrically connecting the portion a32 and the portion a34 with each other; the layer L2 is positioned between the layer L1 and the layer L3; at least a part of the portion a32 and at least a part of the portion a24 face each other in the direction substantially perpendicular to the plane L0; and the split S includes a split Sh3 and a split Sv2, the split Sh3 being formed between the portion a24 and the portion a34, the split Sv2 being formed between the part of the portion a32 and the part of the portion a24 which face each other in the direction substantially perpendicular to the plane L0.

Thus, according to an aspect of the present disclosure, if deformation thereof or dimensional error thereon occurs in the vertical direction for example, the split Sv1 becomes narrowed (widened) in the vertical direction while the split Sv2 becomes widened (narrowed) in the vertical direction, and thereby amount of increase (decrease) of a capacitance of the split Sv1 and amount of decrease (increase) of a capacitance of the split Sv2 partially cancel each other so that change of the capacitance of the split Sv in the vertical direction can be suppressed as a whole. Thus, an aspect of the present disclosure can provide, for example, a split-ring resonator which further reduces effects of its deformation in the vertical direction and its dimensional error in the vertical direction.

For example, a split-ring resonator according to an aspect of the present disclosure (for example, the split ring resonator A2 and its modification) may be configured so that an area of each of the part of the portion a21 and the part of the portion a32, which face each other, is substantially same as an area of each of the part of the portion a32 and the part of a portion a24 which face each other.

For example, a split-ring resonator according to an aspect of the present disclosure (for example, the split ring resonator A2 and its modification) may be configured so that a shape of the portion a21 is substantially same as a shape of the portion a24.

Thus, according to an aspect of the present disclosure, if deformation thereof or dimensional error thereon occurs in the vertical direction for example, the amount of increase (decrease) of the capacitance of the split Sv1 and the amount of decrease (increase) of the capacitance of the split Sv2 cancel each other and thereby change of the capacitance of the split Sv in the vertical direction can be further suppressed as a whole. Thus, an aspect of the present disclosure can provide a split-ring resonator which further reduces effects of its deformation in the vertical direction and its dimensional error in the vertical direction.

For example, a split-ring resonator according to an aspect of the present disclosure (for example, the split ring resonator A2 and its modification) may be configured, for example, as shown in FIG. 4, so that a junction, which connects the portion a22 and the portion a23 with each other, does not overlap with a junction which connects the portion a22 and the portion a25 with each other.

Thus, for example, as compared with a configuration shown in FIG. 3, an aspect of the present disclosure can provide a split-ring resonator whose conductive member a2 is easily formed by bending a piece which is cut out from one conductive board (metal plate) by a laser, etc.

Figure 5:
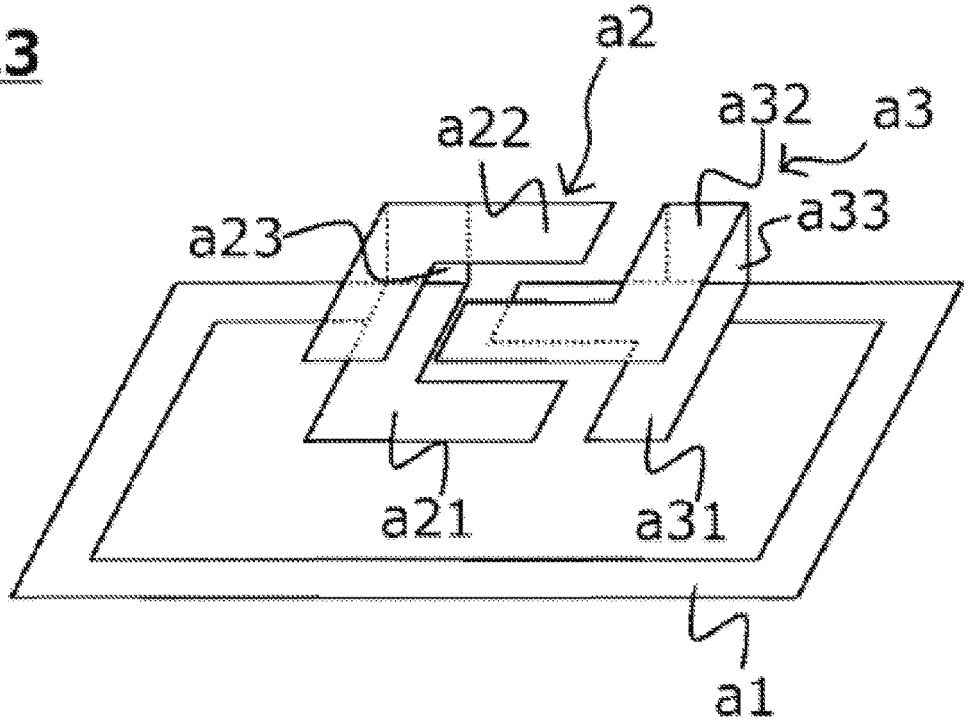
FIG. 5 is a view of an example of a split ring resonator according to an aspect of the present disclosure.
Figure 5:
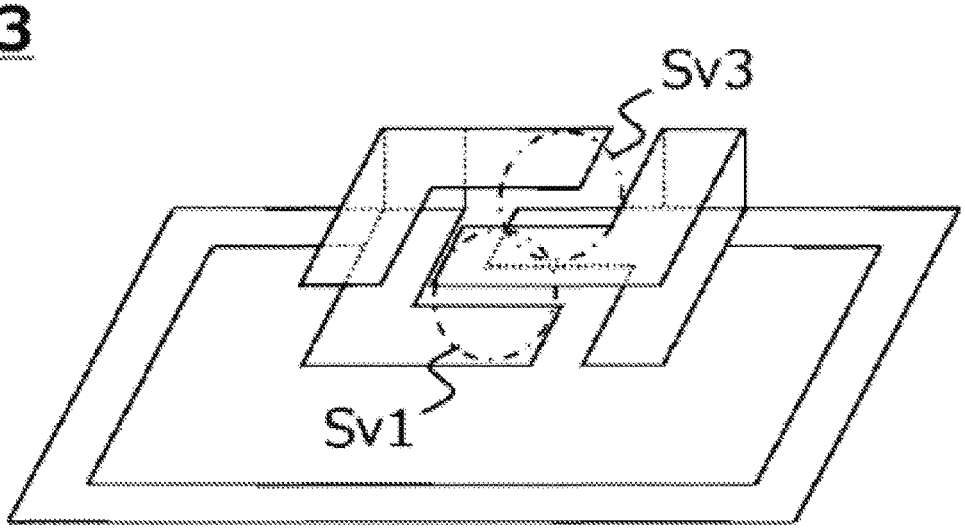
Figure 6:
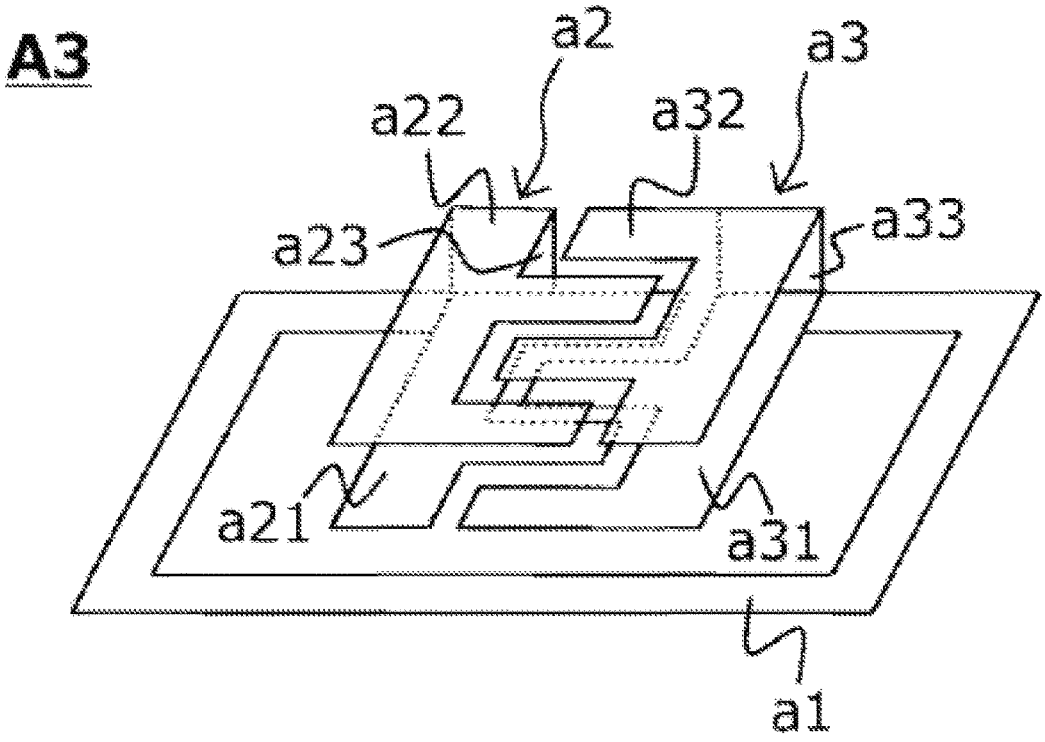
FIG. 6 is a view of an example of a split ring resonator according to an aspect of the present disclosure.
Figure 6:
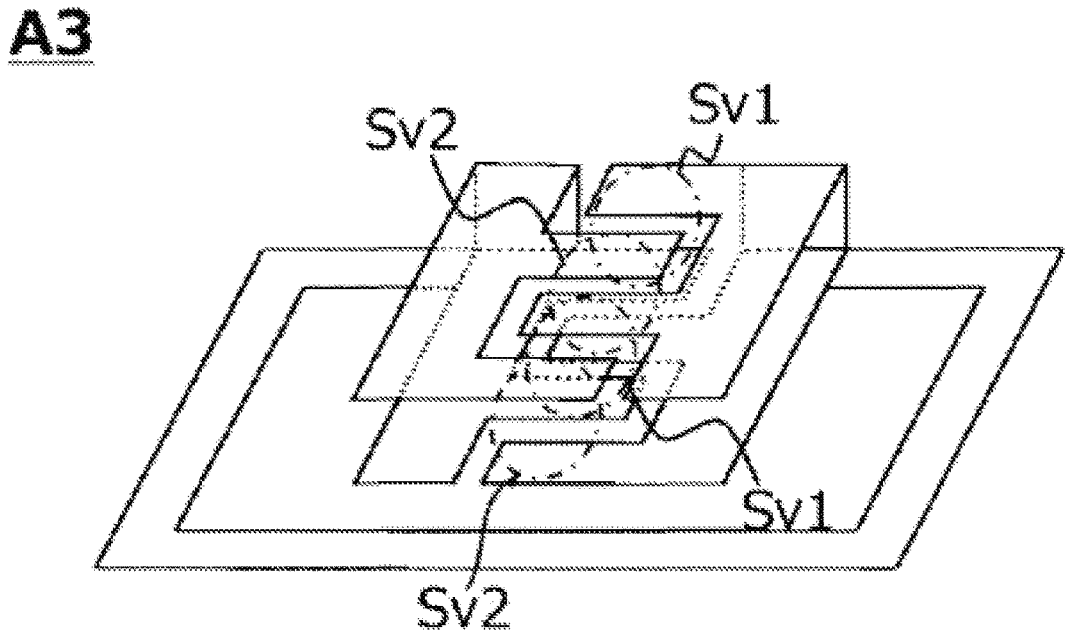
Figure 7:
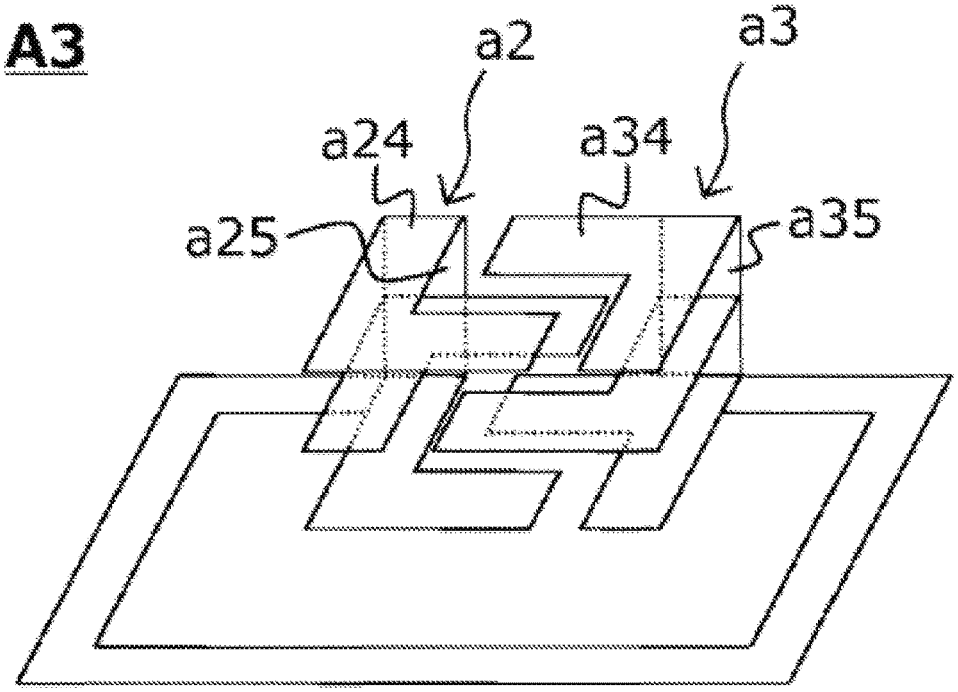
FIG. 7 is a view of an example of a split ring resonator according to an aspect of the present disclosure.
Figure 7:
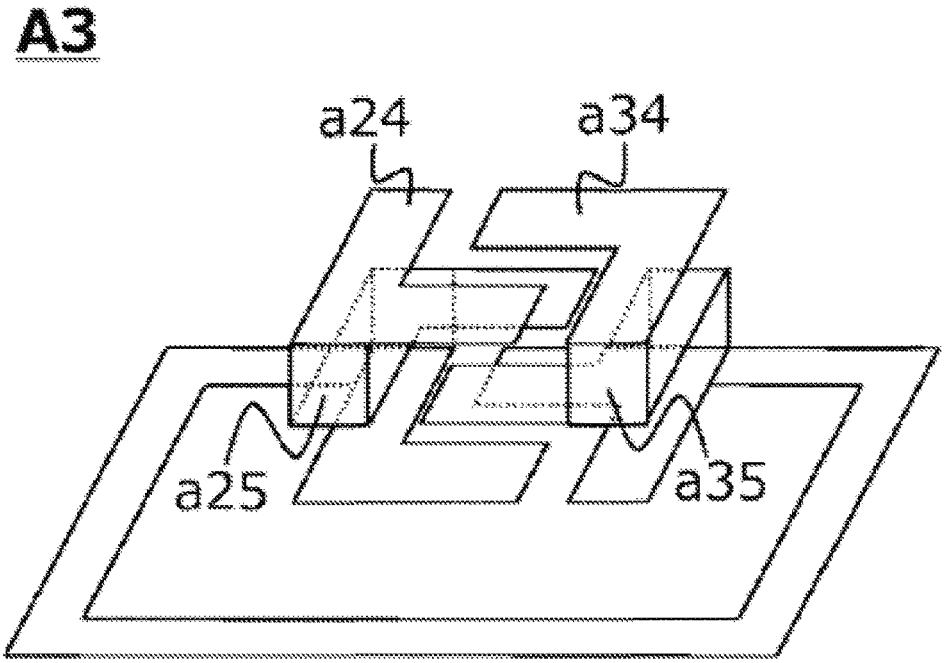

For example, a split-ring resonator according to an aspect of the present disclosure (for example, the split ring resonators A1, A2 and their modifications) may be a split ring resonator A3, for example, as shown in FIGS. 5, 6 and 7 which is configured so that at least a part of the portion a22 and at least a part of the portion a31 face each other in the direction substantially perpendicular to the plane L0; and the split S includes a split Sv3 formed between the part of the portion a22 and the part of the portion a31 which face each other in the direction substantially perpendicular to the plane L0.

For example, the single split Sv1 may be formed on the split ring resonator A3, for example, as shown in FIG. 5, two of the splits Sv1 may be formed on the split-ring resonator A3, for example, as shown in FIG. 6, and a plurality of the splits Sv1 may be formed on the split-ring resonator A3. For example, the single split Sv3 may be formed on the split ring resonator A3, for example, as shown in FIG. 5, two of the splits Sv3 may be formed on the split-ring resonator A3, for example, as shown in FIG. 6, and a plurality of the splits Sv1 may be formed on the split-ring resonator A3.

For example, as shown in FIG. 7, a split ring resonator may have any of the following configurations: at least a part of the portion a32 and at least a part of the portion a24 face each other in the direction substantially perpendicular to the plane L0; at least a part of the portion a33 and at least a part of the portion a35 face each other in the direction substantially perpendicular to the plane L0; and the split S includes a split Sv4 which is formed between the part of the portion a32 and the part of the portion a24 which face each other in the direction substantially perpendicular to the plane P0; and the split S includes a split Sv4 which is formed between the part of the portion a33 and the part of the portion a35 which face each other in the direction substantially perpendicular to the plane P0.

Thus, according to an aspect of the present disclosure, if deformation thereof or dimensional error thereon occurs in the vertical direction for example, the split Sv1 becomes narrowed (widened) in the vertical direction while the split Sv3 becomes widened (narrowed) in the vertical direction, and thereby the amount of increase (decrease) of the capacitance of the split Sv1 and amount of decrease (increase) of a capacitance of the split Sv3 partially cancel each other so that change of the capacitance of the split Sv in the vertical direction can be suppressed as a whole. From above, an aspect of the present disclosure can provide a split-ring resonator which further reduces effects of its deformation in the vertical direction and its dimensional error in the vertical direction.

For example, a split-ring resonator according to an aspect of the present disclosure (for example, the split ring resonator A3 and its modification) may be configured so that an area of each of the part of the portion a22 and the part of the portion a31, which face each other, is substantially same as an area of each of the part of the portion a21 and the part of the portion a32 which face each other.

For example, a split-ring resonator according to an aspect of the present disclosure (for example, the split ring resonator A3 and its modification) may be configured so that a shape of the portion a32 is substantially same as a shape of the portion a21 turned inside out, or may be configured so that a shape of the portion a22 is substantially same as a shape of the portion a31 turned inside out.

Thus, according to an aspect of the present disclosure, if deformation thereof or dimensional error thereon occurs in the vertical direction for example, the amount of increase (decrease) of the capacitance of the split Sv1 and the amount of decrease (increase) of the capacitance of the split Sv3 cancel each other and thereby change of the capacitance of the split Sv in the vertical direction can be further suppressed as a whole. In other words, an aspect of the present disclosure can provide, for example, a split-ring resonator which further reduces effects of its deformation in the vertical direction and its dimensional error in the vertical direction.

Figure 8:
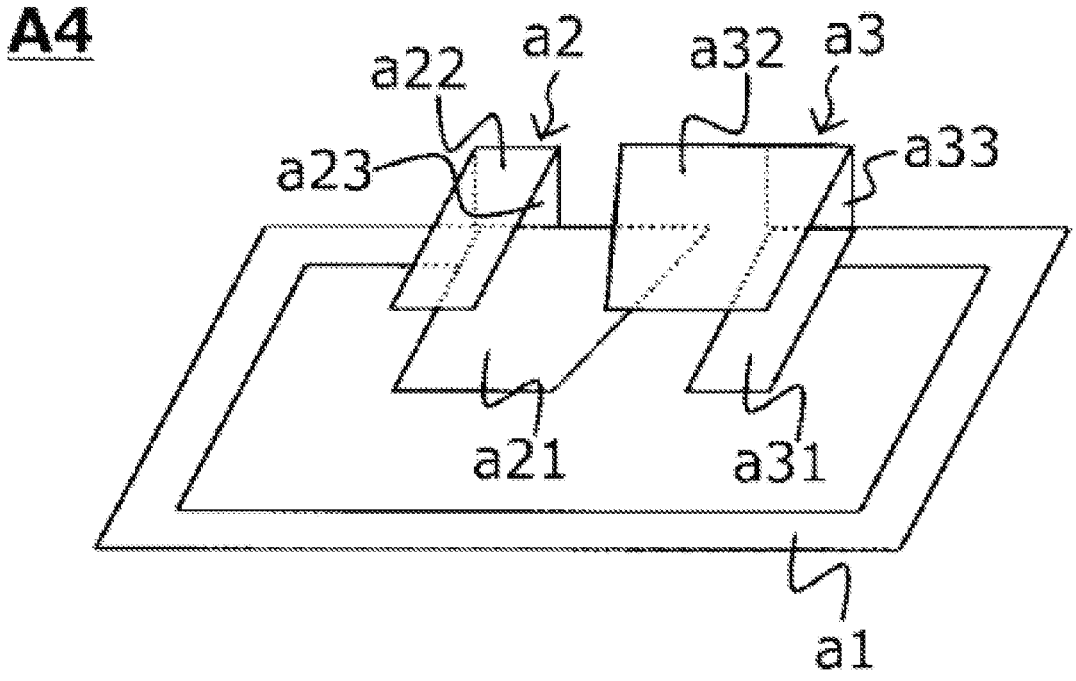
FIG. 8 is a view of an example of a split ring resonator according to an aspect of the present disclosure.

For example, a split-ring resonator according to an aspect of the present disclosure (for example, the split ring resonators A1, A2, A3 and their modifications) may be a split-ring resonator A4, for example, as shown in FIG. 8 which is configured as follows: each of a part of the conductive member a2 and a part of the conductive member a3, which face each other in the direction substantially perpendicular to the plane L0, has an area which is increased toward a portion electrically and mutually connecting portions that belong to different layers For example, there is a case where its deformation in the vertical direction and its dimensional error in the vertical direction have more effects on a portion far from a connecting portion (a23, a33, a25, a35) than a portion close thereto, the connecting portion electrically connecting portions which belong to different layers. An aspect of the present disclosure can suppress the effects by decreasing the areas of the parts of the conductive member a2 and the conductive member a3, which face each other, for example, at locations where its deformation in the vertical direction and its dimensional error in the vertical direction are more effective. Thus, an aspect of the present disclosure can provide a split-ring resonator which further reduces, for example, effects of its deformation in the vertical direction or its dimensional error in the vertical direction.

Figure 9:
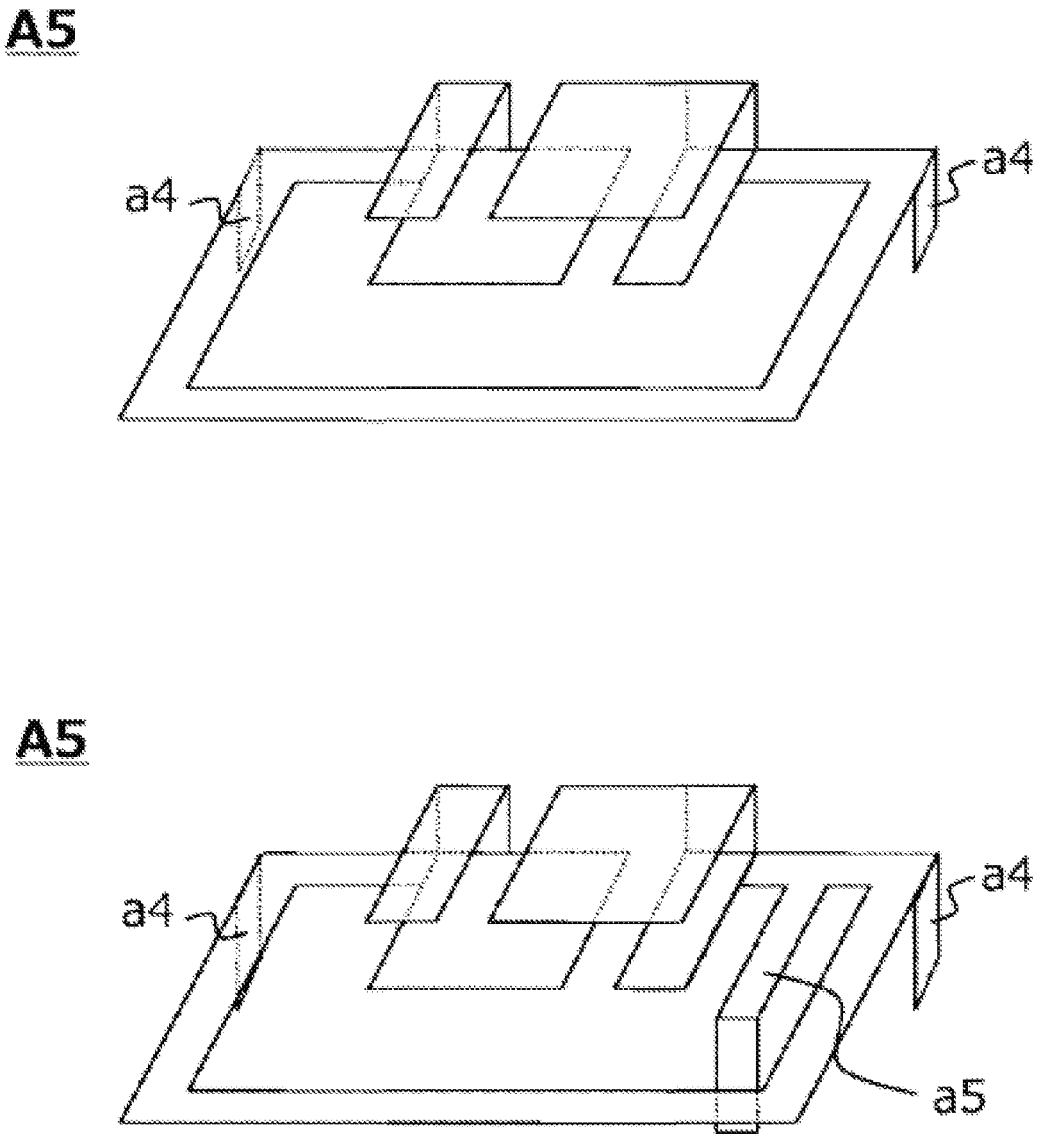
FIG. 9 is a view of an example of a split ring resonator according to an aspect of the present disclosure.
Figure 10:
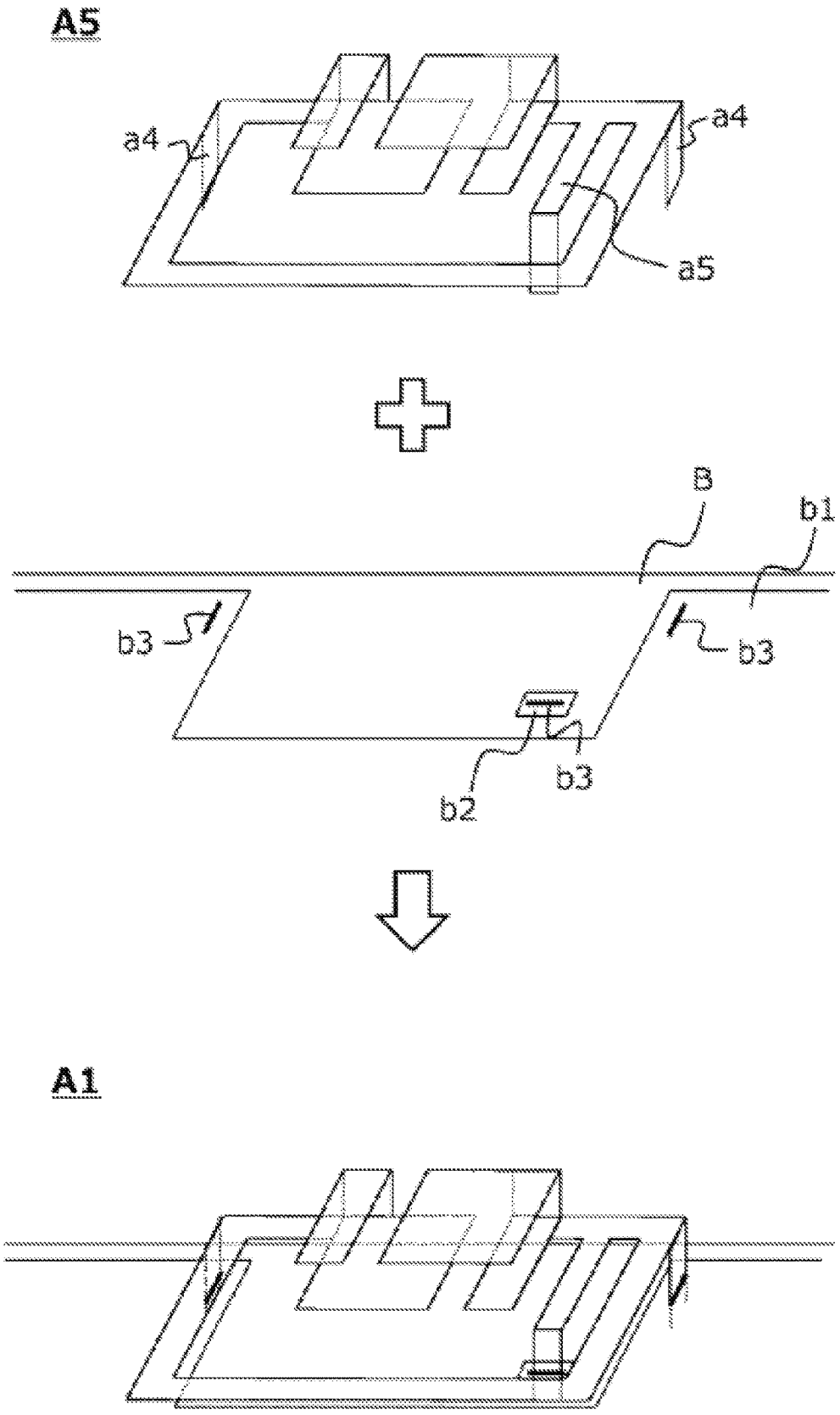
FIG. 10 is a view of an example of a split ring resonator according to an aspect of the present disclosure.

For example, a split-ring resonator according to an aspect of the present disclosure (for example, the split ring resonators A1, A2, A3, A4 and their modification) may be a split ring resonator A5, for example, as shown in FIGS. 9 and 10 which is configured so that the conductive member a1 comprises a ground terminal a4 which is separated from a ground pattern b1.

For example, a split-ring resonator according to an aspect of the present disclosure may comprise the single ground terminal a4, or may comprises a plurality of the ground terminals a4. For example, the ground terminal a4 may have any configuration, provided that the ground terminal a4 is electrically connected with the ground pattern b1. For example, the ground terminal a4 may be made of a sheet metal. For example, the ground terminal a4 may include a land pattern. For example, the ground terminal a4 may include a pattern which protrudes outward from an outer periphery of the conductive member a1. For example, the ground terminal a4 may include an exposed pattern which is formed by partially removing an outer cover of the conductive member a1. For example, the ground terminal a4 may be electrically connected with the ground pattern b1 by soldering, crimping, etc. For example, the conductive member a1 and the ground terminal a4 may be integrally formed by bending a piece which is cut out from one conductive board (metal plate) by a laser, etc. For example, a part of the ground terminal a4 that extends in the vertical direction may extends straight in the vertical direction, or may be curved.

For example, the feed line a5 may extend from its junction with the conductive member a1 toward a side space of the conducive member a1 which is opposite to its junction across the region which is formed inside the conductive member a1. For example, the feed line a5 may extend from its junction with the conductive member a1 across the region which is formed inside the conductive member a1. For example, the feed line a5 may be positioned in the region which is formed inside the conductive member a1, or may be positioned outside the region. For example, a part or whole of the feed line a5 may extend beyond the conductive member a1 in a direction in which the ground terminal a4 extends. For example, a part of the feed line a5 that extends in the vertical direction may extends straight in the vertical direction, or may be curved. For example, the part of the feed line a5 that extends in the vertical direction may be electrically connected with the conductive pattern b2 by soldering, crimping, etc.

When the ground terminal a4 is connected with a terminal b3 of the ground pattern b1 of a circuit board B, for example, as shown in FIG. 10, electrical current, which corresponds to an RF signal fed to the sprit-ring resonator, can flow in the split-ring resonator or the ground pattern according to the aspect of the present disclosure.

For example, the circuit board B may comprise the single terminal b3, or may comprises a plurality of the terminals b3. For example, the terminal b3 may be connected with the part of the ground terminal a4 that extends in the vertical direction. For example, the terminal b3 may have a width corresponding to a width of the ground terminal a4. If, for example, a support is integrated with the ground terminal a4, the terminal b3 may have a width corresponding to a width of the ground terminal a4 integrated with the support. For example, the circuit board B may comprises the ground pattern b1. For example, the circuit board B may comprises a conductive pattern b2, for feeding electrical energy, which includes the terminals b3 corresponding to the part of the feed line a5 that extends in the vertical direction. For example, the conductive pattern b2 for feeding electrical energy may be provided on a part of the circuit board B that faces a sprit-ring resonator according to an aspect of the present disclosure when the terminal b3 is connected with the ground terminal a4. For example, the conductive pattern b2 for feeding electrical energy may be provided on another part of the circuit board B other than the part of the circuit board B which faces the sprit-ring resonator according to the aspect of the present disclosure when the terminal b3 is connected with the ground terminal a4.

Thus, an aspect of the present disclosure, for example, enables a split-ring resonator, whose deformation in the vertical direction hardly occurs, to be put on the market as an individual component or to be combined flexibly according to design requirements.

Figure 11:
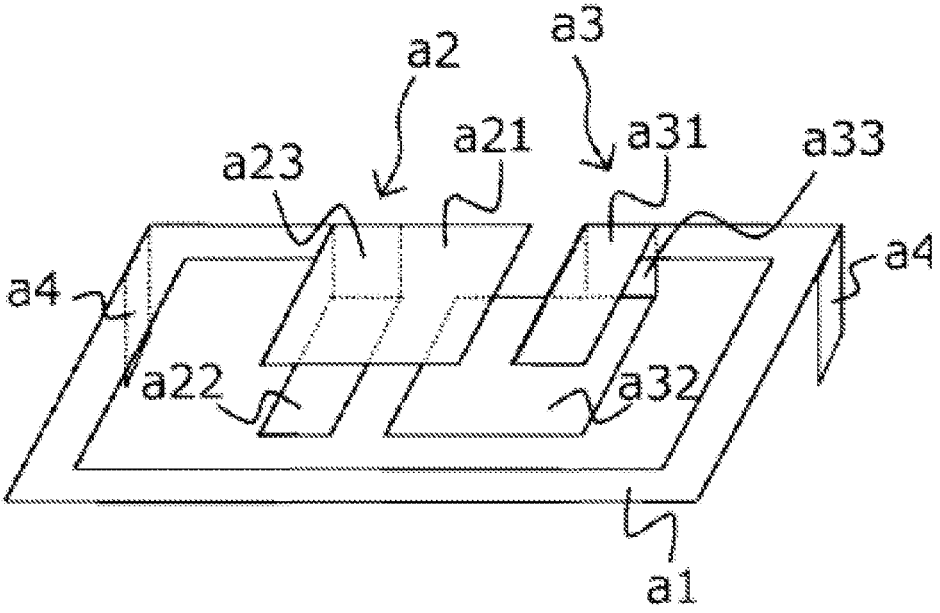
FIG. 11 is a view of an example of a split ring resonator according to an aspect of the present disclosure.
Figure 11:
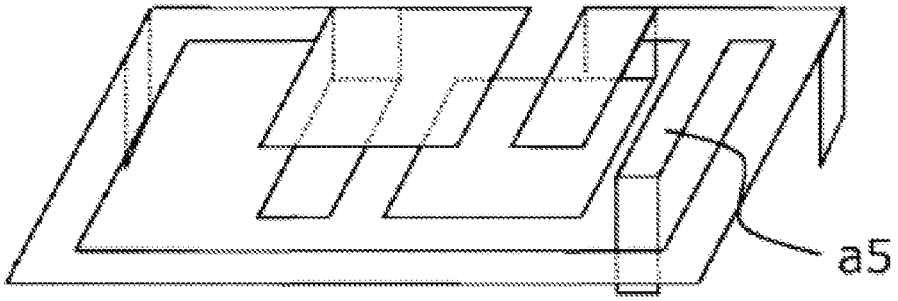
Figure 12:
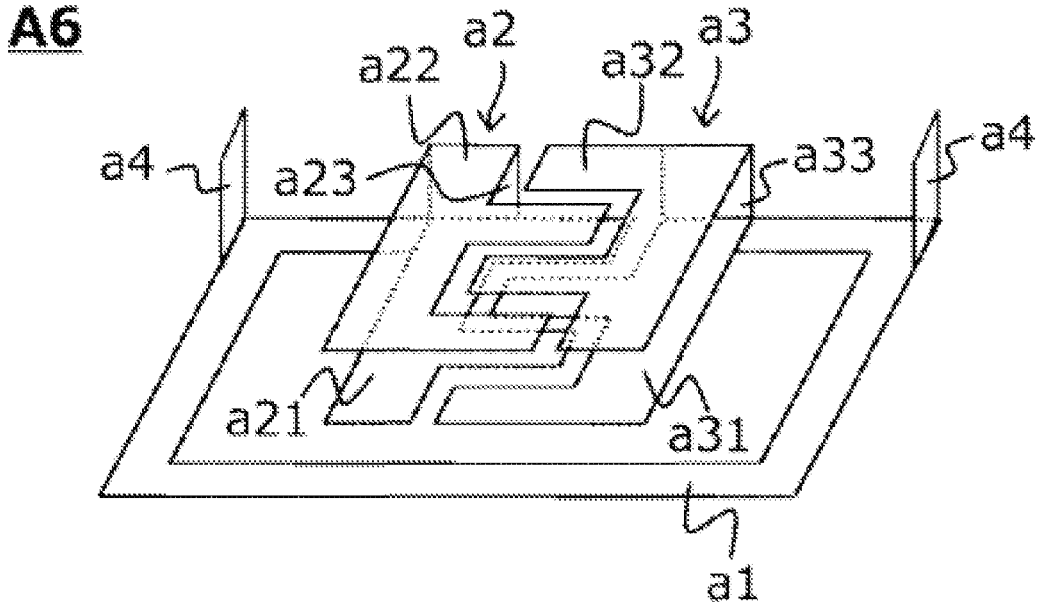
FIG. 12 is a view of an example of a split ring resonator according to an aspect of the present disclosure.
Figure 12:
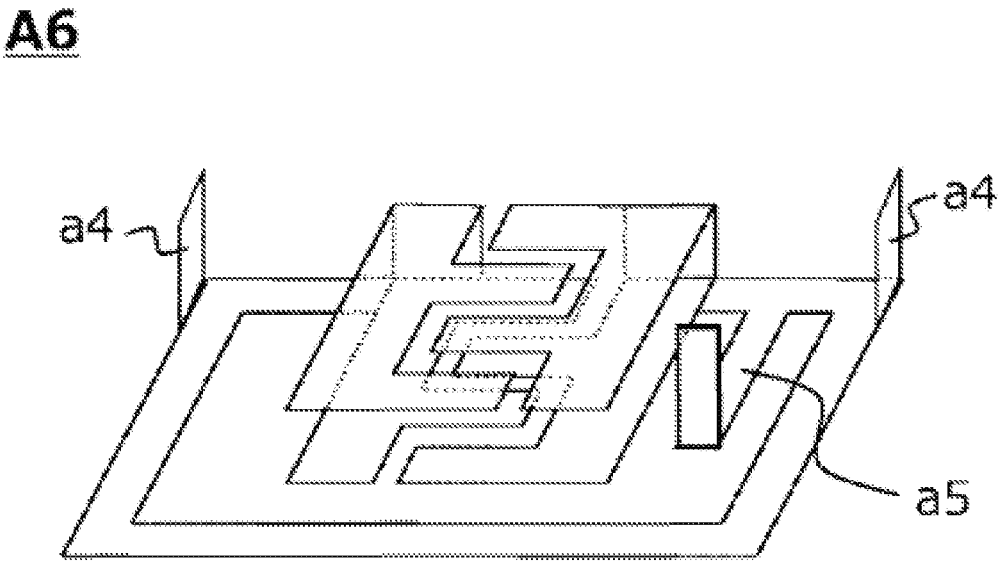
Figure 13:
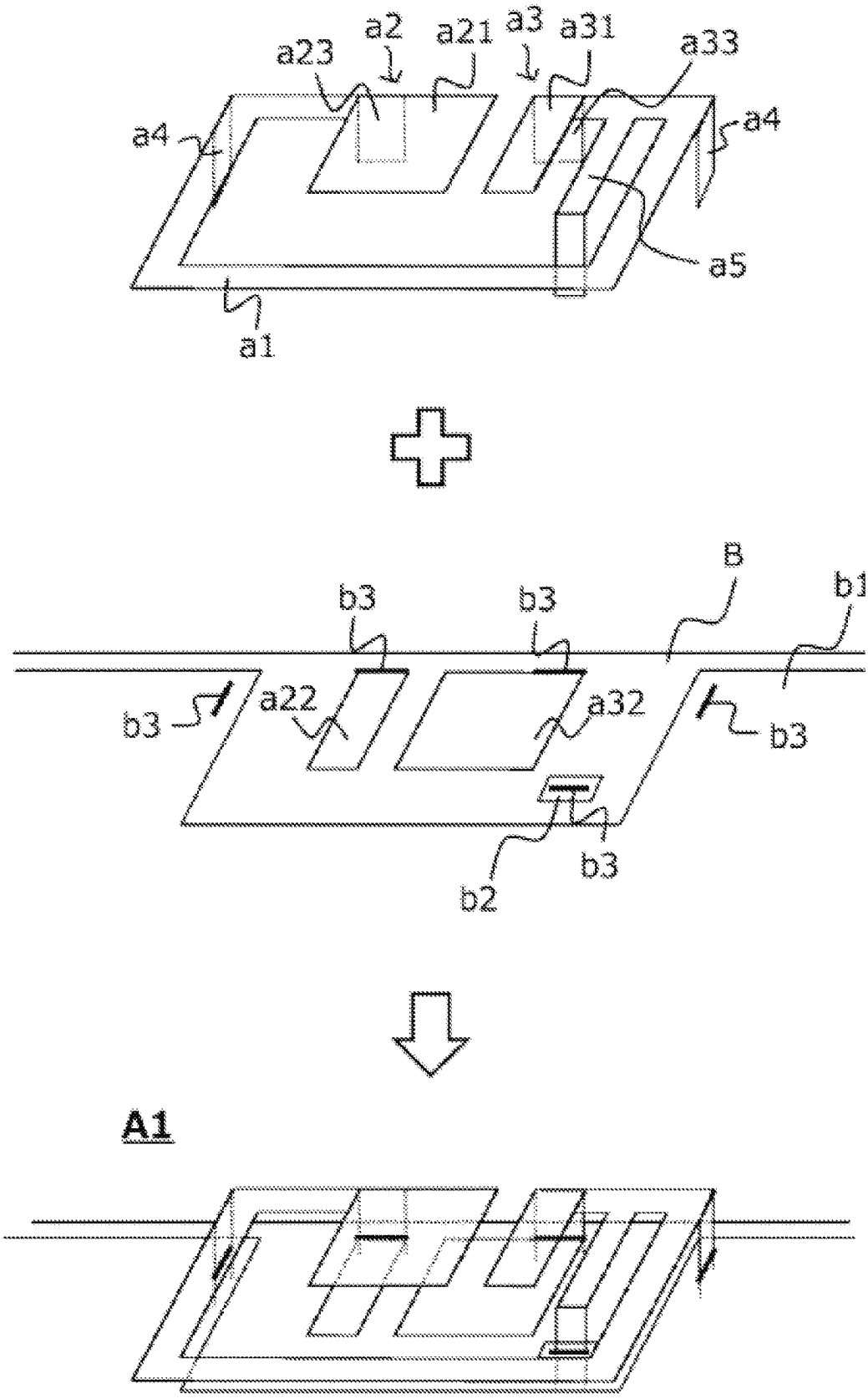
FIG. 13 is a view of an example of a split ring resonator according to an aspect of the present disclosure.

For example, a sprit-ring resonator (for example, sprit-ring resonator A5 and its modification) according to an aspect of the present disclosure may be a split-ring resonator A6, for example, as shown in FIGS. 11 and 12, which is configured so that the layer L1 is same as the plane L0 while the layer L2 is positioned beyond the conductive member a1 in the direction in which the ground terminal a4 extends Thus, an aspect of the present disclosure can provide, for example, a sprit-ring resonator whose deformation in the vertical direction hardly occurs.

For example, a communication device according to an aspect of the present disclosure may comprises a sprit-ring resonator (for example, antennas A1, A2, A3 and A4 and their modifications) according to an aspect of the present disclosure.

Thus, an aspect of the present disclosure can provide, for example, a communication device which can achieve sufficient performance assumed in its design process.

The present application is based on a Japanese patent application of JP2019-078215 filed before the Japan Patent Office on Apr. 17, 2019, the content of which is incorporated herein by reference.

REFERENCE SIGNS LIST

L0: plane
L1, L2, L3: layer
A1, A2, A3, A4, A5, A6: sprit-ring resonator
a1: conductive member
a2 (a21, a22, a23, a24, a25): conductive member
a3 (a31, a32, a33, a34, a35): conductive member
a4: ground terminal
a5: feed line
S (Sh, Sv): split
Sh (Sh1, Sh2, Sh3): split that is substantially parallel to the plane L0
Sv (Sv1, Sv2, Sv3, Sv4, Sv5): split that is substantially perpendicular to the plane L0
B: circuit board
b1: ground pattern
b2: conductive pattern for feeding electrical energy
b3: terminal

The invention claimed is:

1. A split ring resonator including a first conductive member, a second conductive member, and a third conductive member, the first conductive member having a split ring shape, the second conductive member being electrically connected with one end of the first conductive member, the third conductive member being electrically connected with the other end of the first conductive member, and a plurality of splits being formed between the second conductive member and the third conductive member, wherein:

the second conductive member includes a first portion, a second portion, and a third portion, the first portion belonging to a first layer which is a layer substantially parallel to a plane to which the first conductive member belongs, the second portion belonging to a second layer which is a layer which is substantially parallel to the plane and which faces the first layer, and the third portion electrically connecting the first portion and the second portion with each other;

the third conductive member includes a fourth portion, a fifth portion, and a sixth portion, the fourth portion belonging to the first layer, the fifth portion belonging to the second layer, and the sixth portion electrically connecting the fourth portion and the fifth portion with each other;

at least a part of the first portion and at least a part of the fifth portion face each other in a direction substantially perpendicular to the plane;

the plurality of splits include a first split, a second split, and a third split, the first split being formed between the first portion and the fourth portion, the second split being formed between the second portion and the fifth portion, and the third split being formed between the part of the first portion and the part of the fifth portion which face each other in the direction substantially perpendicular to the plane;

the second conductive member includes a seventh portion and an eighth portion, the seventh portion belonging to a third layer which is a layer which is substantially parallel to the plane and which faces the second layer, and the eighth portion electrically connecting the second portion and the seventh portion with each other;

the third conductive member includes a ninth portion and a tenth portion, the ninth portion belonging to the third layer, and the tenth portion electrically connecting the fifth portion and the ninth portion with each other;

the second layer is positioned between the first layer and the third layer;

at least a part of the fifth portion and at least a part of the seventh portion face each other in the direction substantially perpendicular to the plane; and the plurality of splits further include a fourth split and a fifth split, the fourth split being formed between the seventh portion and the ninth portion, and the fifth split being formed between the part of the fifth portion and the part of the seventh portion which face each other in the direction substantially perpendicular to the plane.

2. The split ring resonator as recited in claim 1, wherein, in an LC resonant circuit of the split ring resonator, a capacitance produced at a split from among the plurality of splits that is substantially parallel to the plane is not negligibly small with respect to a capacitance produced at a split from among the plurality of splits that is substantially perpendicular to the plane.

3. The split ring resonator as recited in claim 1, wherein an area of each of the part of the first portion and the part of the fifth portion, which face each other, is substantially the same as an area of each of the part of the fifth portion and the part of the seventh portion which face each other.

4. The split ring resonator as recited in claim 1, wherein a shape of the first portion is substantially the same as a shape of the seventh portion.

5. The split ring resonator as recited in claim 1, wherein a junction, which connects the second portion and the third portion with each other, does not overlap with a junction which connects the second portion and the eighth portion with each other.

6. A communication device comprising the split ring resonator as recited in claim 1.

7. A split ring resonator including a first conductive member, a second conductive member, and a third conductive member, the first conductive member having a split ring shape, the second conductive member being electrically connected with one end of the first conductive member, the third conductive member being electrically connected with the other end of the first conductive member, and a split being formed between the second conductive member and the third conductive member, wherein:

the second conductive member includes a first portion, a second portion, and a third portion, the first portion belonging to a first layer which is a layer substantially parallel to a plane to which the first conductive member belongs, the second portion belonging to a second layer which is a layer which is substantially parallel to the plane and which faces the first layer, and the third portion electrically connecting the first portion and the second portion with each other;

the third conductive member includes a fourth portion, a fifth portion, and a sixth portion, the fourth portion belonging to the first layer, the fifth portion belonging to the second layer, and the sixth portion electrically connecting the fourth portion and the fifth portion with each other;

at least a part of the first portion and at least a part of the fifth portion face each other in a direction substantially perpendicular to the plane;

the split includes a first split, a second split, and a third split, the first split being formed between the first portion and the fourth portion, the second split being formed between the second portion and the fifth portion, and the third split being formed between the part of the first portion and the part of the fifth portion which face each other in the direction substantially perpendicular to the plane;

at least a part of the second portion and at least a part of the fourth portion face each other in the direction substantially perpendicular to the plane; and the split further includes a sixth split formed between the part of the second portion and the part of the fourth portion which face each other in the direction substantially perpendicular to the plane.

8. The split ring resonator as recited in claim 7, wherein an area of each of the part of the second portion and the part of the fourth portion, which face each other, is substantially the same as an area of each of the part of the first portion and the part of the fifth portion which face each other.

9. The split ring resonator as recited in claim 7, wherein:

a shape of the fifth portion is substantially the same as a shape of the first portion turned inside out; and a shape of the second portion is substantially the same as a shape of the fourth portion turned inside out.

10. A split ring resonator including a first conductive member, a second conductive member, and a third conductive member, the first conductive member having a split ring shape, the second conductive member being electrically connected with one end of the first conductive member, the third conductive member being electrically connected with the other end of the first conductive member, and a split being formed between the second conductive member and the third conductive member, wherein:

the second conductive member includes a first portion, a second portion, and a third portion, the first portion belonging to a first layer which is a layer substantially parallel to a plane to which the first conductive member belongs, the second portion belonging to a second layer which is a layer which is substantially parallel to the plane and which faces the first layer, and the third portion electrically connecting the first portion and the second portion with each other;

the third conductive member includes a fourth portion, a fifth portion, and a sixth portion, the fourth portion belonging to the first layer, the fifth portion belonging to the second layer, and the sixth portion electrically connecting the fourth portion and the fifth portion with each other;

at least a part of the first portion and at least a part of the fifth portion face each other in a direction substantially perpendicular to the plane;

the split includes a first split, a second split, and a third split, the first split being formed between the first portion and the fourth portion, the second split being formed between the second portion and the fifth portion, and the third split being formed between the part of the first portion and the part of the fifth portion which face each other in the direction substantially perpendicular to the plane; and each of a part of the second conductive member and a part of the third conductive member, which face each other in the direction substantially perpendicular to the plane, has an area which increases toward a portion electrically and mutually connecting portions that belong to different layers.

11. A split ring resonator including a first conductive member, a second conductive member, and a third conductive member, the first conductive member having a split ring shape, the second conductive member being electrically connected with one end of the first conductive member, the third conductive member being electrically connected with the other end of the first conductive member, and a split being formed between the second conductive member and the third conductive member, wherein:

the second conductive member includes a first portion, a second portion, and a third portion, the first portion belonging to a first layer which is a layer substantially parallel to a plane to which the first conductive member belongs, the second portion belonging to a second layer which is a layer which is substantially parallel to the plane and which faces the first layer, and the third portion electrically connecting the first portion and the second portion with each other;

the third conductive member includes a fourth portion, a fifth portion, and a sixth portion, the fourth portion belonging to the first layer, the fifth portion belonging to the second layer, and the sixth portion electrically connecting the fourth portion and the fifth portion with each other;

at least a part of the first portion and at least a part of the fifth portion face each other in a direction substantially perpendicular to the plane;

the split includes a first split, a second split, and a third split, the first split being formed between the first portion and the fourth portion, the second split being formed between the second portion and the fifth portion, and the third split being formed between the part of the first portion and the part of the fifth portion which face each other in the direction substantially perpendicular to the plane; and the first conductive member comprises a ground terminal which is separated from a ground pattern.

12. The split ring resonator as recited in claim 11, wherein:

the first layer is coplanar with the plane; and the second layer is positioned beyond the first conductive member in a direction in which the ground terminal extends.

* * * * *